US006880731B2

(12) United States Patent
Heukamp

(10) Patent No.: US 6,880,731 B2
(45) Date of Patent: Apr. 19, 2005

(54) DISPENSER FOR FLOWABLE PRODUCTS WITH SPHERICALLY ENCAPSULATED COMPONENTS

(75) Inventor: Wolfgang Heukamp, Swisttal (DE)

(73) Assignee: RPC Wiko GmbH & Co. KG, Pulheim (DE)

( * ) Notice: Subject to any disclaimer, the term of this patent is extended or adjusted under 35 U.S.C. 154(b) by 59 days.

(21) Appl. No.: 10/376,463

(22) Filed: Feb. 28, 2003

(65) Prior Publication Data

US 2003/0168477 A1 Sep. 11, 2003

(30) Foreign Application Priority Data

Mar. 5, 2002 (DE) ..... 202 03 473 U

(51) Int. Cl.[7] ..... B65D 88/54
(52) U.S. Cl. ..... 222/321.7; 222/387
(58) Field of Search ..... 222/321.7, 383.3, 222/387

(56) References Cited

U.S. PATENT DOCUMENTS 4,402,431 A * 9/1983 Wiegner et al. ..... 222/207
6,240,979 B1 * 6/2001 Lorscheidt ..... 141/2
6,371,333 B1 * 4/2002 Lorscheidt et al. ..... 222/321.9

FOREIGN PATENT DOCUMENTS

| | | |
|---|---|---|
| DE | 3619192 | 12/1987 |
| DE | 3828811 | 3/1989 |
| DE | 3507355 | 8/1990 |
| DE | 3837704 | 3/1994 |
| DE | 689 08 688 T2 | 3/1994 |
| DE | 196 37 101 A1 | 3/1998 |
| DE | 297 17 037 U1 | 3/1999 |
| DE | 696 07 634 T2 | 8/2000 |
| DE | 101 08 299 A1 | 1/2002 |

* cited by examiner

*Primary Examiner*—Philippe Derakshani
(74) *Attorney, Agent, or Firm*—Friedrich Kueffner

(57) ABSTRACT

A dispenser head of a dispenser for dispensing metered quantities of liquid and pasty products with spherically encapsulated components includes a dispenser pump and a dispenser duct with applicator opening following the dispenser pump for metered dispensing of products, wherein the dispenser pump includes an inlet duct and an outlet duct and a pump chamber closed at the inlet and outlet sides by check valves. At least one screen-like perforated mask is arranged in the product flow from the pump chamber during the dispensing procedure toward the outlet side, such that the entire product quantity must pass through the perforated mask during the dispensing procedure.

11 Claims, 1 Drawing Sheet

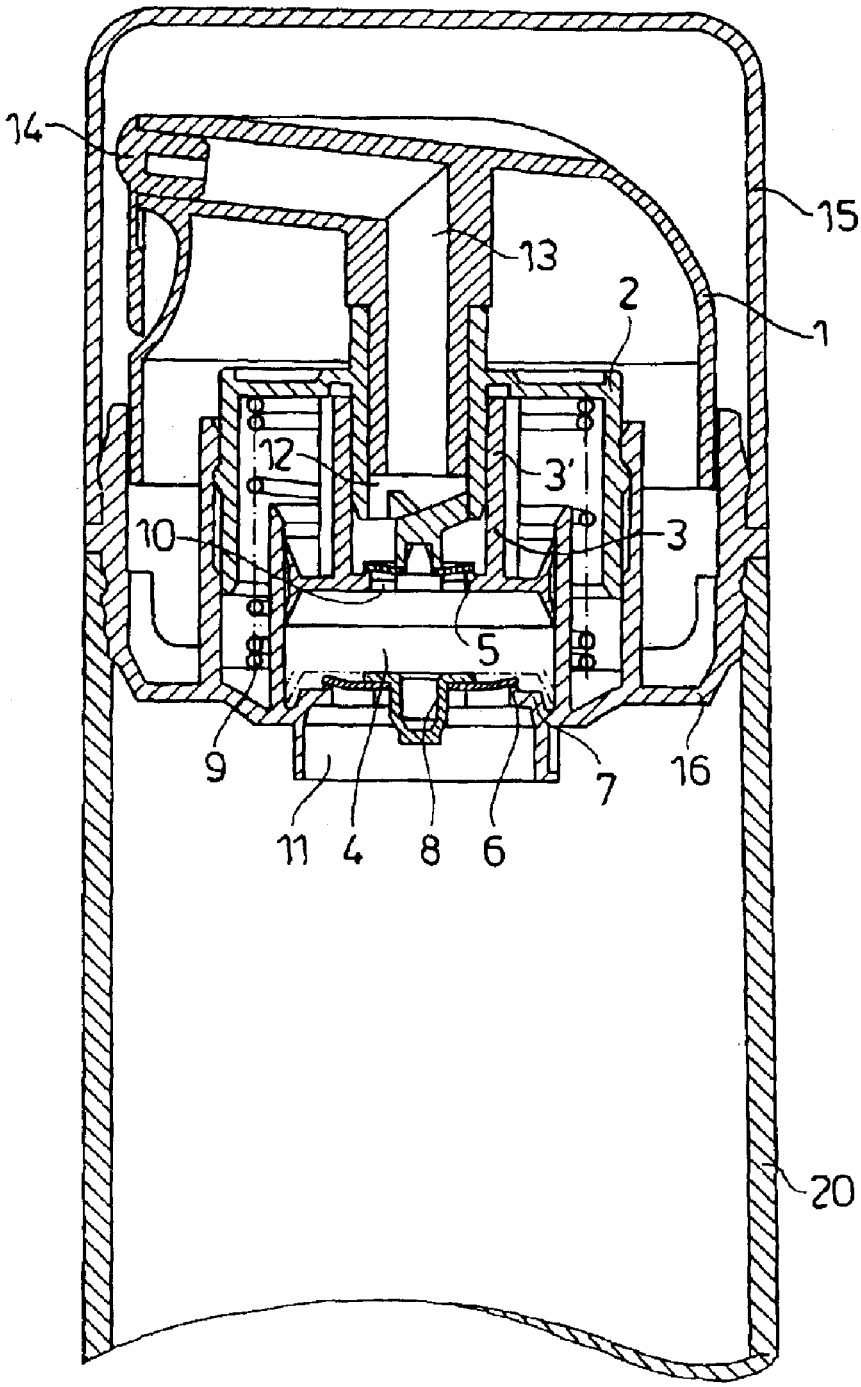
14
15
13
2
1
12
3'
10
3
5
9
7
16
11
4
8
6
20

DISPENSER FOR FLOWABLE PRODUCTS WITH SPHERICALLY ENCAPSULATED COMPONENTS

BACKGROUND OF THE INVENTION

1. Field of the Invention

The invention relates to a dispenser head of a dispenser for dispensing metered quantities of liquid and pasty products with spherically encapsulated components. The dispenser head includes a dispenser pump and a dispenser duct with applicator opening following the dispenser pump for metered dispensing of products, wherein the dispenser pump includes an inlet duct and an outlet duct and a pump chamber closed at the inlet and outlet sides by check valves.

2. Description of the Related Art

For metered dispensing of liquid and pasty products, various devices are known in the art for pressing a product out of a storage container through an applicator opening. These devices differ fundamentally with respect to their structural configurations and their manner of operation.

DE 35 07 355 C2 discloses a paste dispenser with a hollow-cylindrical dispenser housing which is opened to atmosphere at the lower end thereof and is closed by a follower piston, wherein the dispenser housing includes at its upper end an axially displaceable pump piston with a tubular piston rod. The upper pump piston and the lower follower piston define a paste chamber therebetween. For metered dispensing of paste, a downwardly directed external pressure acting on the upper pump piston presses paste out of the paste chamber through the hollow piston rod to the applicator opening. After the pump piston has been returned by the force by a spring, the vacuum produced in the paste chamber pulls the follower piston upwardly. This procedure can be repeated until the paste chamber is empty and the follower piston has contact with the pump piston.

DE 38 377 04 C2 discloses a dispenser for pasty products with a metering pump for dispensing metered quantities from bottle or can-like paste containers. The dispenser includes a bellows of a rubber-elastic material which is arranged between and so as to connect two housing parts of plastics material which is stable with respect to shape, wherein the housing parts engage telescopically into each other in the axial direction. The housing parts are moveable relative to each other between two stops and can be returned by axial restoring spring forces. For dispensing the paste, an external pressure applied to the housing parts guides the housing parts downwardly, so that the paste contained within the bellows is pressed through the housing parts to the applicator opening. When the external pressure is no longer applied, the housing parts are returned by the spring force of the bellows. As a result of this restoring movement, a valve at the lower opening of the bellows which is now open causes the bellows to be filled again, while the follower piston is also moved upwardly at the same time.

Also known in the art are dispensers with a dispenser pump arranged in the dispenser head, wherein the pump chamber is defined at the inlet and outlet sides by check valves. Arranged within the pump chamber, which is closed as a result is an axially displaceable pressure piston which can be pressed downwardly by an external pressure and, after the external pressure is no longer applied, is returned into its initial position by means of springs arranged in the pump chamber.

The dispensers discussed above have in common a dispenser pump arranged in the dispenser head which, when the pump is actuated by means of the external pressure, the product to be dispensed is pressed through an applicator opening.

In order to protect the active ingredients in products or to provide a special "gag", more and more producers tend to encapsulate these ingredients in the form of small spheres and to add the spheres to the product. The encapsulated material has only a low mechanical strength, so that, when the product is used, for example, by applying to the skin or into the hair, the spheres are manually destroyed and the active ingredients are released.

SUMMARY OF THE INVENTION

Starting from the prior art discussed above, it is the primary object of the present invention to provide a dispenser of the above-described type with a dispenser head which ensures that almost all spheres or all spheres having a certain defined size are destroyed or squashed already in the dispenser head by the pressure introduced into the dispenser head.

In accordance with the present invention, at least one screen-like perforated mask is arranged in the product flow from the pump chamber during the dispensing procedure toward the outlet side, such that the entire product quantity must pass through the perforated mask during the dispensing procedure.

The dispensing pressure, which is introduced into the pump chamber for the dispensing procedure and is produced by a pressure piston or a flexible chamber and which displaces the product present in the pump chamber and forces it toward the applicator opening, causes the product to be pressed against and through the perforated mask which is arranged within the pump chamber or in flow direction behind the pump chamber. Any spherically encapsulated ingredients contained in the product whose diameter is greater than the individual sizes of the perforations of the perforated mask are pressed by the pressure in the product against the perforated mask, while smaller spherically encapsulated ingredients can pass at least partially without obstruction through the perforated mask. Consequently, by appropriately selecting the size of the perforations, the size of the spheres to be destroyed can be predetermined. If the entire quantity of spheres is to be destroyed, this can be effected by a screen-like perforated mask having particularly small perforations.

When the invention is used in a pump chamber containing a pressure piston, the complete destruction of the spherically encapsulated ingredients can be additionally ensured by moving the bottom surface of the displaceable pressure piston during the downwardly stroke resulting from the external pressure almost to the bottom of the pump chamber. The remaining spheres are then destroyed in this end position of the pressure piston in the remaining space between the piston bottom surface and the pump chamber bottom.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

The single FIGURE of the drawing is a sectional view of a dispenser head according to the present invention.

DESCRIPTION OF THE PREFERRED EMBODIMENTS

As illustrated in the drawing, a dispenser head 1 has as a basis a receiving ring 16 whose lower part is inserted into the upper end of a storage container 20 and is locked thereto. A closing cap 15 is placed on the upper portion of the receiving ring 16.

Arranged within the receiving ring 16 is a dispenser pump 2 composed of a displaceably arranged pressure piston 3 which is held in its upper position by means of restoring springs 9, and a pump chamber 4 formed by the pressure piston 3 and the lower surface of the receiving ring 16, i.e., the pump chamber bottom 7. The pump chamber 4 is connected to the storage container 20 through an open inlet duct 11 which can be closed by an inlet valve 6 attached within the pump chamber 4 by means of a plug 8.

Toward the dispensing duct 13 and the subsequently arranged applicator opening 14 with removable closure plug, the pump chamber 4 is connected to an open outlet duct 12 which can be closed by an outlet valve 5 arranged on the outside of the pressure piston 3. Immediately in front of the outlet valve 5 in the outlet direction, the screen-like perforated mask 10 is arranged in accordance with the invention in the pressure piston 3 in such a way that the entire product quantity passing through the outlet valve 5 is also conducted through this perforated mask 10.

The dispensing duct 13 is rigidly connected through the outlet duct 12 and a locking connection to the pressure piston neck 3'. During the dispensing procedure, during which the pressure piston 3 is also pressed down together with the dispensing duct 13, the volume of the pump chamber 4 is reduced and, depending on the stroke of the pressure piston 3, a partial quantity of the product is pressed from the pump chamber 4 through the perforated mask 10 to the outlet duct 12 and further to the applicator opening 14.

While specific embodiments of the invention have been shown and described in detail to illustrate the inventive principles, it will be understood that the invention may be embodied otherwise without departing from such principles.

I claim:

1. A dispenser head of a dispenser for dispensing quantities of flowable products with spherically encapsulated ingredients, the dispenser head comprising a dispenser pump, a dispenser duct with applicator opening following the dispenser pump for dispensing the products, the dispenser pump having an inlet duct and an outlet duct and a pump chamber with check valves at the inlet and outlet sides, and at least one screen-like perforated mask arranged in the pump chamber such that during a dispensing procedure the entire product flow passes through the perforated mask.

2. The dispenser head according to claim 1, wherein the perforated mask has perforations, and wherein the diameters of the perforations are at least partially smaller than the diameters of the spherically encapsulated ingredients of the product.

3. The dispenser head according to claim 2, wherein the diameters of the perforations have a defined predetermined size.

4. The dispenser head according to claim 1, wherein the perforated mask is arranged in the outlet duct following the pump chamber.

5. The dispenser head according to claim 1, wherein the perforated mask is arranged in flow direction immediately in front of the check valve of the pump chamber on the outlet side.

6. The dispenser head according to claim 1, wherein the pump chamber has flexible pump chamber walls for producing a pressure to be introduced into the pump chamber for the flow of the product through the perforated mask.

7. The dispenser head according to claim 6, wherein the check valve of the pump chamber on the outlet side is an outlet valve, and wherein the outlet valve and the perforated mask are components of a moveable part of the flexible pump chamber walls.

8. The dispenser head according to claim 6, wherein the pump chamber has a cover and a bottom, and wherein the pump chamber cover is moveable by the flexible pump chamber walls to the pump chamber bottom, wherein the pump chamber bottom is stationary.

9. The dispenser head according to claim 8, further comprising an axially displaceable pressure piston arranged within the pump chamber for applying pressure on the product.

10. The dispenser head according to claim 9, wherein the outlet valve and the perforated mask are components of the pressure piston.

11. The dispenser head according to claim 9, wherein the pressure piston is mounted in the pump chamber so as to be moveable with a bottom surface thereof immediately up to the pump chamber bottom.

* * * * *